United States Patent [19]

Futakuchi et al.

[11] Patent Number: 4,536,211

[45] Date of Patent: Aug. 20, 1985

[54] WASTE GAS CIRCULATION METHOD AND SYSTEM FOR SINTERING APPARATUS

[75] Inventors: Takashi Futakuchi, Nishinomiya; Kiyofumi Nakamura, Kitakyushu; Yoshimasa Sato, Niihama; Toshio Tsukuda, Niihama; Hiroyuki Shiraishi, Niihama, all of Japan

[73] Assignees: Sumitomo Metal Industries, Ltd., Osaka; Sumitomo Heavy Industries Ltd., Tokyo, both of Japan

[21] Appl. No.: 495,373

[22] Filed: May 17, 1983

[30] Foreign Application Priority Data

May 18, 1982 [JP] Japan ..... 57-82421

[51] Int. Cl.[3] ..... F27B 9/12

[52] U.S. Cl. ..... 75/5; 266/44; 266/155; 266/156

[58] Field of Search ..... 75/5; 266/44, 155, 156, 266/178; 432/90, 91

[56] References Cited

U.S. PATENT DOCUMENTS 4,371,150 2/1983 Tsukuda ..... 75/5

FOREIGN PATENT DOCUMENTS 49-1361 1/1974 Japan ..... 266/156

*Primary Examiner*—L. Dewayne Rutledge

*Assistant Examiner*—Robert L. McDowell

*Attorney, Agent, or Firm*—Flynn, Thiel, Boutell & Tanis

[57] ABSTRACT

Herein disclosed are both waste gas circulation method and system for effectively recovering waste heat from an on-strand type sintering apparatus which has its sintering and cooling zones extending continuously along a horizontal strand. The hottest waste gases coming from the final stage of the sintering zone and the front stage of the cooling zone, in which the sintering reaction of a charge mixture is completed, are subjected to heat recovery, and sulfur oxides in the hottest gases are prevented from condensing on the water pipe or pipes of a waste-heat boiler by preheating the water, which is supplied for the heat recovery, with the still hot waste gases coming from the downstream half of the cooling zone. The heat of the still hot waste gases are exchanged with cold water so that this water may be heated into hot water. On the other hand, the heat of the hottest gases is exchanged with steam so that this steam may be heated into superheated steam. Moreover, the heat of the hot waste gases obtained as a result of the second-named heat exchanging step is further exchanged with the hot water heated at the first-named heat exchanging step. Thus, it is possible to conduct the ore sintering operation of regenerative type while assuring that the boiler components in those heat exchanging operations will not be corroded by the waste gases.

9 Claims, 5 Drawing Figures

WASTE GAS CIRCULATION METHOD AND SYSTEM FOR SINTERING APPARATUS

BACKGROUND OF THE INVENTION

1. Field of the Invention

The present invention relates generally to a conveyor type sintering apparatus having a sintering zone and a cooling zone extending along a horizontal conveyor and, more particularly, to both a waste gas circulation method and a waste gas circulation system for heat recovery of the conveyor type sintering apparatus.

2. Description of the Prior Art

In the prior art, there have been proposed a variety of waste-heat recovering methods for a sintering apparatus, all of which have not succeeded in providing an efficient one. In other words, the methods thus far proposed have failed to reach the level of the so-called "regenerative cooling cycle" in which such energy is generated as can sufficiently cover that to be consumed for driving the sintering apparatus itself.

The sintering apparatus existing in the art is generally divided into two types, namely, a separate type, in which a sintering machine and a cooling machine are so separately arranged that the sintered ore product discharged from the former is introduced into a cooled by the latter after it has been crushed, and a conveyor type in which a sintering zone and a cooling zone immediately following the former zone are formed to extend along a horizontal conveyor.

In the separate type sintering apparatus, heat radiation takes place while the sintered ore product, which is still hot, is being crushed, and pallets of the sintering machine, which have conveyed both the charge mixture of ore, solid fuel and flux to be sintered and the sintered ore product, are returned back in a still hot state to receive a fresh charge mixture while allowing its heat to radiate to the surrounding atmosphere. This makes it rather difficult to effectively recover the heat which remains conserved in the cooling machine. Another heat loss is caused while the sintered ore product is being transferred from the sintering machine to the cooling machine. In the cooling machine, moreover, the sinter supplied has been so roughly crushed that it has a limited surface area to be effective for the cooling operation. As a result, the sintered ore product or sinter cannot be sufficiently cooled down unless the flow rate of cooling air is increased. This inevitably lowers the temperature of the waste gases coming from the downstream half of the cooling machine, thus making it difficult to recover the heat from the relatively cool waste gases. Therefore, no separate type sintering apparatus of the prior art has endeavored to recover any heat from the downstream half of its cooling machine. Even if, on the other hand, it is intended to recover the heat from the waste gases coming from the upstream half of the cooling machine, it is unnecessary to preheat a heat transferring medium such as water because those waste gases contain no sulfur oxides $SO_x$. On the contrary, the water has to be preheated in case the waste gases coming from the intermediate and downstream portions of the sintering machine are to be subjected to a heat exchanging process. This is because those waste gases contain such a considerable amount of $SO_x$ that condensation of sulfuric acid is undesirably likely to occur.

In the latter type, i.e., conveyor type sintering apparatus having its sintering and cooling zones formed along the common conveyor, the heat recovery is conducted only from the waste gases coming from the cooling zone while allowing the sensible heat of the hot waste gases to uselessly dissipate into the atmosphere. In this respect, more specifically, the waste gases coming from the cooling zone, especially, from the downstream portion of the same zone are sufficiently hot as to permit the heat recovery therefrom. This is because the sinter in the cooling zone shrinks to generate fine cracks all over the secion of the cooling zone so that its effective surface area to be cooled can be so increased as to reduce the flow rate of the cooling air and to shorten the cooling time period.

SUMMARY OF THE INVENTION

It is, therefore, an object of the present invention to provide a waste gas circulation method for effectively recovering the heat which might otherwise be released from a conveyor type sintering apparatus having its sintering and cooling zones extending continuously along a horizontal conveyor.

Another object of the present invention is to provide a waste gas circulation system for putting the above-specified method into practice by repeatedly circulating the waste gases through a charge mixture of ore, solid fuel and flux being sintered and through the sintered ore product thereby to effectively recover the heat which might otherwise be carried away by the waste gases discharged.

The present invention is based upon the aforementioned differences between the separate type and conveyor type sintering apparatus and has been conceived in view of the facts that the waste gases discharged from the sintering apparatus take their maximum temperature at a point where the sintering reaction is completed in the actual run of the sintering apparatus, namely, where the cooling operation is started, and that the maximum temperature point and its neighborhood act as an important zone for recovering that sensible heat.

The gist of the present invention resides in that the hottest waste gases in the vicinity of the conveyor, i.e., at the final stage of the sintering zone and at the front stage of the cooling zone, in which the sintering reaction is completed, are subjected to heat recovery, and in that the problem, which naturally takes place in the case of the heat recovery, namely, the condensation of sulfur oxides $SO_x$ of the waste gases in the form of droplets of sulfuric acid, is prevented by preheating the water, which is supplied for the purpose of that heat recovery, with the waste gases coming from the downstream half of the cooling zone.

According to a feature of the present invention, there is provided a waste gas circulation method for heat recovery of conveyor type sintering apparatus which includes: a sintering zone having a plurality of wind boxes; and a cooling zone extending just downstream of said sintering zone and having a plurality of wind boxes, comprising: a first step of exchanging the heat of still hot waste gases coming from the wind boxes belonging to both the intermediate stage and at least a portion of the final stage of said cooling zone with cold water to recover said heat thereby to heat said cold water into hot water; and a second step of exchanging the heat of the hot waste gases coming directly from the wind boxes belonging to a mixed zone consisting of the final stage of said sintering zone and the front stage of said cooling zone with the hot water, which has been heated in the first-named heat exchanging step, whereby to recover the second-named heat thereby to heat said hot water to transform it into steam, whereby the heat generated by the sintering action of a charge mixture of ore, solid fuel and flux can be efficiently recovered as said steam from a sintered ore product, and whereby sulfur oxides, which are carried in the hot waste gases having passed through both the wind boxes belonging to the final stage of said sintering zone and wind boxes belong to the front stage of said cooling zone, can be maintained at a relatively high temperature during the second-named heat exchanging step by the hot water, which has recovered the heat of said still hot waste gases, so that said sulfur oxides can be prevented from condensing in the form of droplets of sulfuric acid while ensuring substantially corrosion-free operation of the second-named heat exchanging step.

According to another feature of the present invention, there is provided a waste gas circulation method for heat recovery of a conveyor type sintering apparatus which includes: a sintering zone having a plurality of wind boxes; and a cooling zone extending just downstream of said sintering zone and having a plurality of wind boxes, comprising: a first step of exchanging the heat of still hot waste gases coming from the wind boxes belonging to both the intermediate stage and at least a portion of the final stage of said cooling zone with cold water to recover said heat thereby to heat said cold water into hot water; a second step of exchanging the heat of the hottest waste gases coming directly from the wind boxes belonging to a mixed zone consisting of the final state of said sintering zone and the front stage of said cooling zone with steam to recover the second-named heat thereby to heat said steam into superheated steam; and a third step of exchanging the heat of the waste gases, which have been subjected to the second-named heat exchanging step, with the hot water, which has been heated at the first-named heat exchanging step, to recover the third-named heat thereby to heat said hot water into the steam which is to be heated at the second-named heat exchanging step, whereby the heat generated by the sintering action of a charge mixture of ore, solid fuel and flux can be efficiently recovered as said steam from a sintered ore product, and whereby sulfur oxides, which are carried in the hot waste gases having passed through both the wind boxes belonging to the final stage of said sintering zone and wind boxes belong to the front stage of said cooling zone, can be maintainerd at a relatively high temperature during the second-and third-named heat exchanging steps by the hot water, which has recovered the heat of said still hot waste gases, so that said sulfur oxides can be prevented from condensing in the form of droplets of sulfuric acid while ensuring substantially corrosion-free operation of the second-named heat exchanging step.

According to still another feature of the present invention, there is provided a waste gas circulation system for heat recovery of a conveyor type sintering apparatus which includes: a sintering conveyor arranged generally in a horizontal direction; conveying means for conveying a charge mixture of ore, solid fuel and flux along said sintering conveyor; feeding means for feeding said conveying means with said charge mixture; ignition means for igniting the solid fuel in said charge mixture at the surface thereof so that the sintering of said charge mixture may be started; and a plurality of wind boxes arranged on line below and opened toward said charge mixture through the pallets of said sintering conveyor, said wind boxes being so grouped as to belong to an ignition zone, which underlies said ignition means, a sintering zone, in which the sintering reaction of said charge mixture proceeds until it is completed, and a cooling zone in which a sintered ore product resulting from said sintering reaction is cooled down, comprising: first heat exchanging means for exchanging the heat of still hot waste gases coming from the wind boxes belonging to both the intermediate stage and at least a portion of the final stage of said cooling zone with cold water to recover said heat thereby to heat said cold water into hot water: first waste gas circulating means for sucking and supplying fresh air to the sintered ore product at both the intermediate stage and at least a portion of the final stage of said cooling zone, and for circulating the still hot waste gases, which have passed through said wind boxes of said intermediate and final stages of said cooling zone, through said first heat exchanging means to the charge mixture, which is being and has been sintered at a mixed zone consisting of the final stage of said sintering zone and the front stage of said cooling zone; second heat exchanging means for exchaging the heat of the waste gases coming directly from the wind boxes belonging to said mixed zone with steam to recover the second-named heat to heat said steam into superheated steam; third heat exchanging means disposed in tandem downstream of said second heat exchanging means for exchanging the heat of the hottest waste gases, which have passed through said second-named heat exchanging means, to recover the third-named heat thereby to heat said hot water into the steam which is to be heated by said second-named heat exchanging means; second waste gas circulating means for sucking and supplying said hottest waste gases to the second-named heat exchanging means and then to the third-named heat exchanging means and for circulating the waste gases, which have passed through said second- and third-named heat exchanging means, to the charge mixture which is to be sintered at the front and intermediate stages of said sintering zone.

BRIEF DESCRIPTION OF THE DRAWINGS

Other objects, features and advantages of the present invention will become more apparent from the following description taken in conjunction with the accompanying drawings, in which.

DESCRIPTION OF THE PREFERRED EMBODIMENTS

Figure 1:
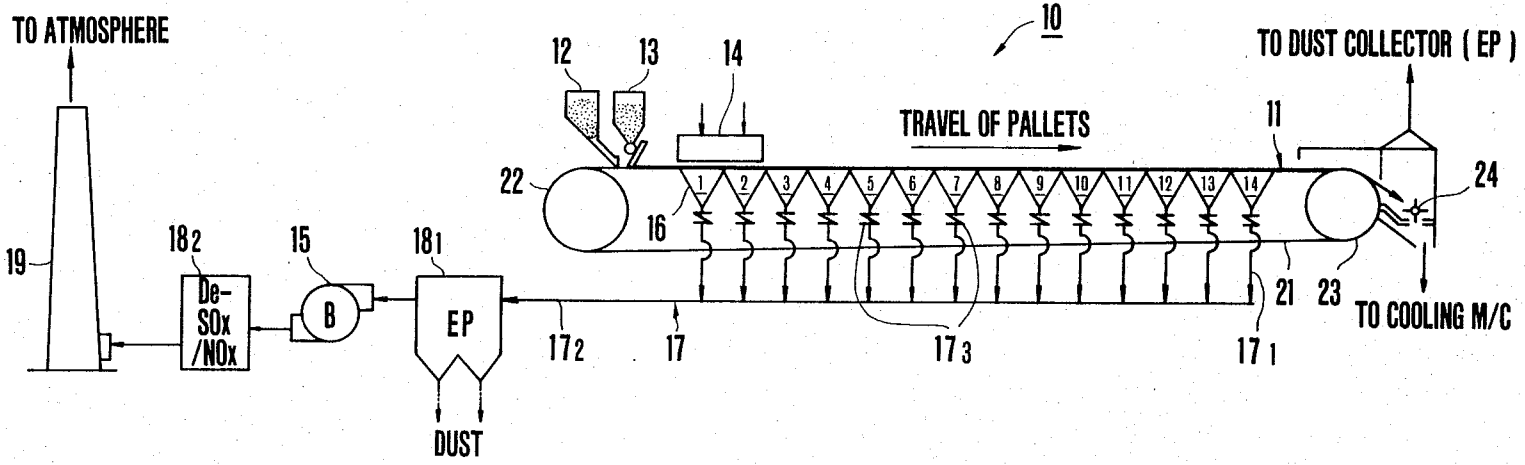
FIG. 1 PRIOR ART
FIG. 1 is a schematic view showing the arrangement of an example of a separate type sintering apparatus according to the prior art.

Before entering into a detailed description of the present invention, a cursory review will now be made upon the separate type sintering apparatus of the prior art, which is indicated generally at reference numeral 10. Indicated at reference numeral 11 is a sintering conveyor which is arranged to extend in a horizontal direction.

The sintering conveyor 11 supports a plurality of pallets (not shown) which are driven to travel in series therealong so that they are successively fed with a hearth layer and a charge mixture of ore, solid fuel and flux from a hearth layer hopper 12 and a mixture surge hopper 13, respectively. As the pallets on the sintering conveyor 11 travel, the charge mixture is ignited at its surface by the action of an ignition furnace 14 so that the sintering reaction of the charge mixture may be started. At the same time, fresh air is sucked by the action of a suction blower 15 through the charge mixture by way of a plurality of wind boxes 16, which are arranged on line below the sintering conveyor 11 and which are consecutively numbered at 1 to 14 and through a suction system 17 so that the resultant waste gases may be introduced into an electrostatic precipitator $\mathbf{18}_1$ and subsequently into a disulfurating and denitrating device $\mathbf{18}_2$. The suction system 17 is composed of a corresponding number of branch ducts or downcomers $\mathbf{17}_1$, which are respectively connected with the wind boxes 16 (i.e., Nos. 1 to 14), and a truck duct or collector main $\mathbf{17}_2$ which is connected with the downcomers 17*1* in a merging manner and which has its downstream portion extending through the electrostatic precipitator $\mathbf{18}_1$, the suction blower 15 and the desulfurating and denitrating device $\mathbf{18}_2$. Moreover, the downcomers $\mathbf{17}_1$ are respectively equipped with valves $\mathbf{17}_3$ for controlling the respective flow rates of the waste gases therethrough. The waste gases thus cleared of the duct and the $SO_x$ and $NO_x$ are discharged from the collector main $\mathbf{17}_2$ to the atmosphere by way of a stack 19. Incidentally, the pallets are driven to travel on rails 21, which are mounted on the sintering conveyor 11, by the rotations of a charge side sprocket 22 and a discharge side sprocket 23.

As those pallets travel along the sintering conveyor 11, the charge mixture is ignited at its surface by the action of the ignition furnace 14. The solid fuel in the charge mixture thus ignited sinters the ore more deeply into the charge mixture as this mixture is conveyed from the feed end to the discharge end. The resultant sinter or the sintered ore product is crushed by means of a crusher 24. The crushed sinter is fed to a cooling machine (not shown) in which it is cooled down. In this meanwhile, the amount of dust resulting from the crushing operation is so large that it has to be carried by suction to a dust collector (not shown, but which may be of the electrostatic type).

Figure 2:
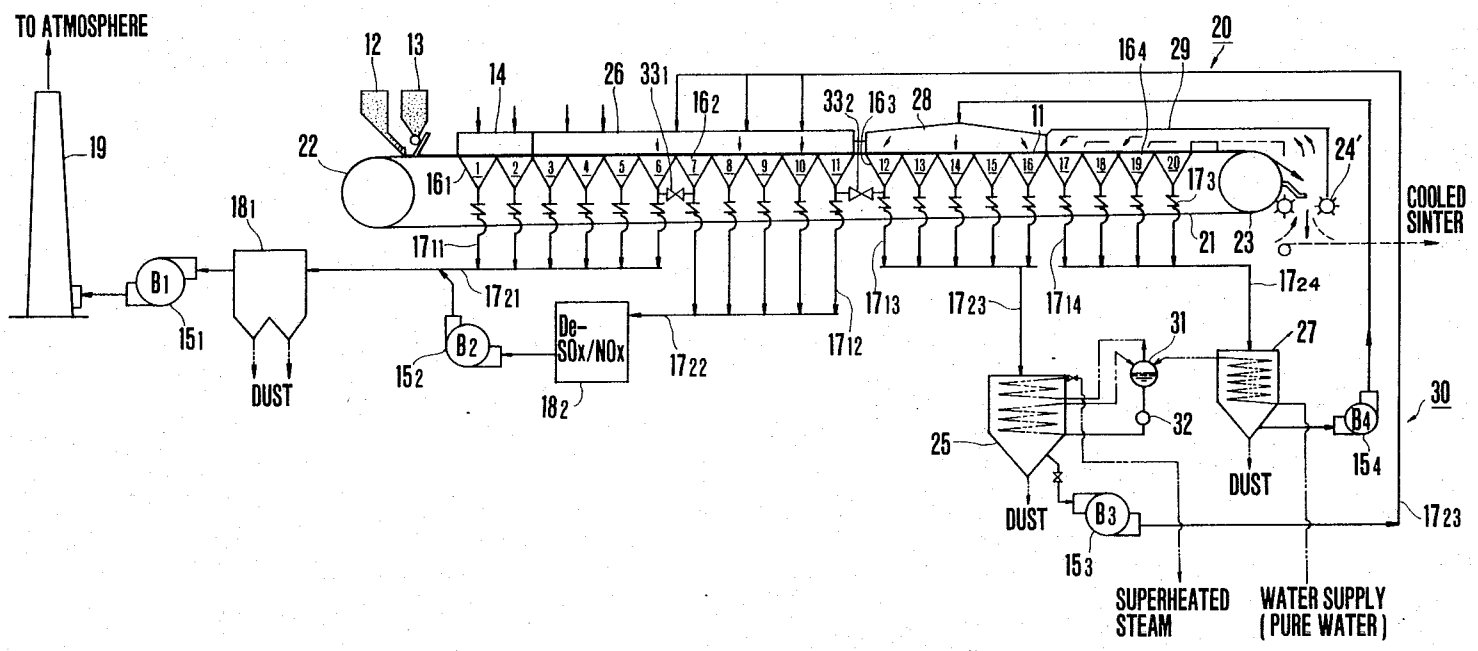
FIG. 2 is also a schematic view but shows the arrangement of a conveyor type sintering apparatus which is equipped with a waste gas circulation system embodying the present invention.

Turning now to FIG. 2, a conveyor type sintering apparatus, which is indicated generally at reference numeral 20 and which is equipped with a waste gas circulation system 30 according to the present invention, will be described. Incidentally, like reference numerals indicate like or corresponding parts of the sintering apparatus 10 of the prior art shown in FIG. 1. Below the conveyor 11 of the sinteriing apparatus 20, there are arranged on line a number, e.g., twenty, of wind boxes. These wind boxes are divided into a first group of wind boxes $\mathbf{16}_1$ (which are numbered at 1 to 6), a second group of wind boxes $\mathbf{16}_2$ (which are numbered at 7 to 11), third and fourth groups of wind boxes $\mathbf{16}_3$ (which are numbered at 12 to 16), and fifth and sixth groups of wind boxes $\mathbf{16}_4$ (which are numbered at 17 to 20).

More specifically, the first group of wind boxes $\mathbf{16}_1$ are further grouped into the wind boxes Nos. 1 and 2, which belong to the ignition zone underlying the ignition furnace 14, and into the wind boxes Nos. 3 to 6, which belong to the front stage of the sintering zone where the sintering reaction of the charge mixture proceeds. The second group of wind boxes Nos. 7 to 11 belong to the intermediate stage of the sintering zone where that sintering reaction further proceeds. The third and fourth groups of wind boxes Nos. 12 to 16 belong, respectively, to the final stage of the sintering zone, where that sintering reaction is completed, and to the front stage of a cooling zone where the sintered ore product is cooled down. The fifth and sixth groups of wind boxes Nos. 17 to 20 belong, respectively, to the intermediate and final stages of the cooling zone where the sinter or sintered ore product is sufficiently cooled down for the subsequent crushing operation by means of a crusher 24'.

The first group wind boxes $\mathbf{16}_1$, i.e., Nos. 1 to 6, are connected with the stack 19 through an electrostatic precipitator $\mathbf{18}_1$ and a blower $\mathbf{15}_1$ by way of the downcomers $\mathbf{17}_{11}$ and the collector main $\mathbf{17}_{21}$. On the other hand, the second group of wind boxes $\mathbf{16}_2$, i.e., Nos. 7 to 11, are made to merge into the collector main $\mathbf{17}_{21}$ through a desulfurating and denitrating device $\mathbf{18}_2$ and a blower $\mathbf{15}_2$ by way of the downcomers $\mathbf{17}_{12}$ and the collector main $\mathbf{17}_{22}$. On the contrary, the third and fourth groups of wind boxes $\mathbf{16}_3$, i.e., Nos. 12 to 16, are connected through the downcomers $\mathbf{17}_{13}$ and the collector main $\mathbf{17}_{23}$ with a waste-heat boiler 25 so that the waste gases may be circulated, after they have exchanged their heat with hot water or steam flowing through water pipes, to a sintering zone hood 26 by the action of a blower $\mathbf{15}_3$. Moreover, the fifth and sixth groups of wind boxes $\mathbf{16}_4$, i.e., Nos. 17 to 20, are connected through the downcomers $\mathbf{17}_{14}$ and the collector main $\mathbf{17}_{24}$ with a waste-heat boiler 27 so that the waste gases may be circulated, after they have exchanged their heat with the water flowing through a water pipe, to a mixed zone hood 28 by the action of a blower $\mathbf{15}_4$. Incidentally, reference numeral 29 indicates a fresh air guide hood which extends above the pallets travelling over the wind boxes Nos. 17 to 20 of the intermediate and final stages of the cooling zone and above the discharge end of the sintering apparatus 20 for guiding fresh air into the sinter. The fresh air guide hood 29 forms a compartment that is opened toward the discharge end for allowing the dust, which might otherwise drop down to the outside, to be returned together with the fresh air to the sinter.

Figure 3:
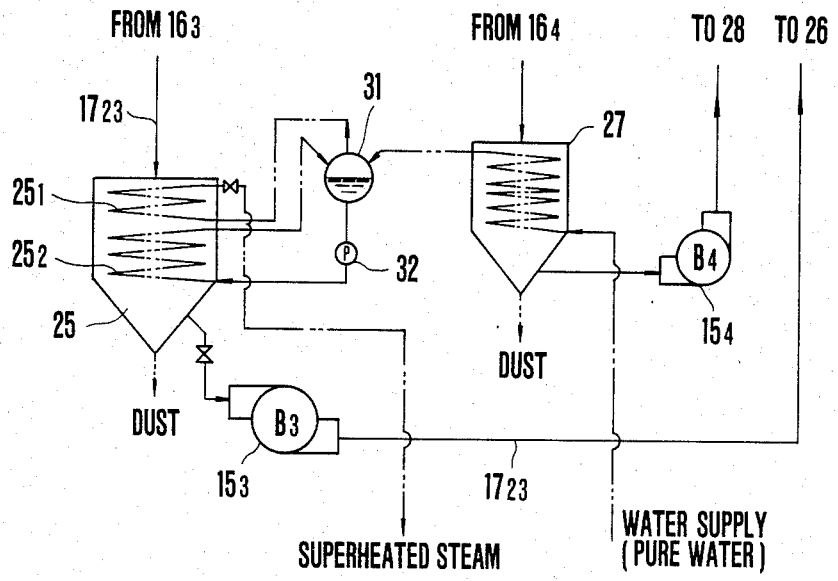
FIG. 3 is an enlarged flow chart showing an essential portion of the waste gas circulation system of FIG. 2 for regeneratively cooling the sintered ore product so as to effectively recover its heat through heat exchanging operations.

Pure water is supplied from the outside to flow through the water pipe of the waste-heat boiler 27 until the resultant hot water flows into a steam drum 31, as better seen from FIG. 3. On the other hand, the hot water reserved in the lower portion of the steam drum 31 is pumped out by the action of a pump 32 to the evaporator portion $\mathbf{25}_2$ of the waste-heat boiler 25 so that it is heated into steam, which is returned to the steam drum 31. The steam thus reserved in the upper portion of the steam drum 31 is guided through the superheater portion $\mathbf{25}_1$ of the waste-heat boiler 25, in which it is heated into superheated steam. This superheated steam is then discharged to the outside so that its energy may be recovered as electric power by driving a steam turbine or the like.

Reverting to FIG. 2, incidentally, reference numerals $33_1$ and $33_2$ indicate dampers which are connected, respectively, between the downcomers $17_{11}$ and $17_{12}$ leading from the wind boxes $16_1$ and $16_2$ of the front and intermediate stages of the sintering zone and between the downcomers $17_{12}$ and $17_{13}$ leading from the wind boxes $16_2$ of the intermediate stage of the sintering zone and the wind boxes $16_3$ of the mixed zone. The dampers $33_1$ and $33_2$ thus connected are provided for finely adjusting the suction pressures of the blowers $15_1$, $15_2$ and $15_3$ thereby to damp down the fluctuations in the resistance to the waste gas flows through the charge mixture, which is to be, is being and has been sintered, due to changes in the thickness of the charge mixture and so on.

Figure 4:
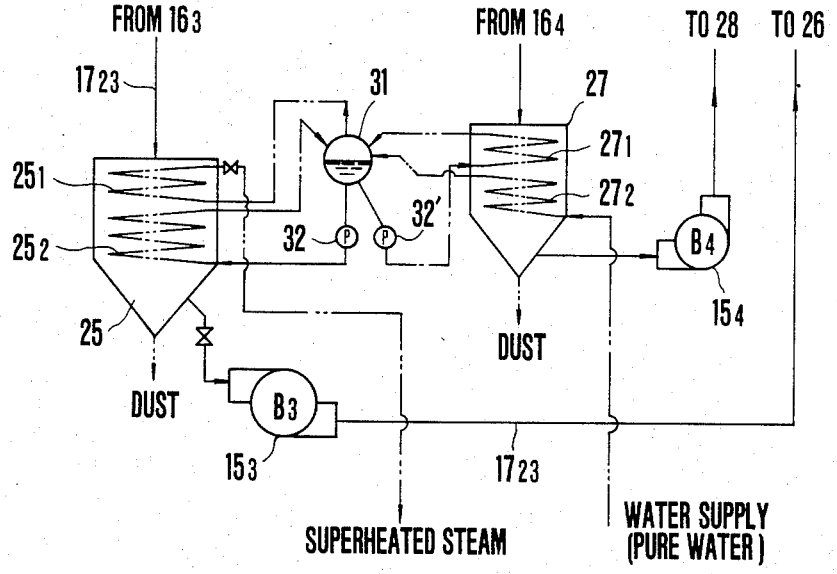
FIG. 4 is similar to FIG. 3 but shows another embodiment of the waste gas circulation system according to the present invention.

Turning now to FIG. 4, there is shown another embodiment of the present invention, in which the water pipe of the waste-heat boiler 27 is also divided into two portions, i.e., an evaporator portion $27_1$ and an economizer portion $27_2$ both connected with the steam drum 31. The remaining construction is absolutely the same as the first embodiment shown in FIG. 3, and the description to be made in the following is accordingly directed only to the different portion of the construction.

The pure water is supplied at a flow rate, which corresponds to the steam generation rate of the waste-heat boilers 25 and 27, first to the economizer portion $27_2$ of the waste-heat boiler 27, in which it is preheated until it flows into the steam drum 31. On the other hand, the hot water reserved in the lower portion of the steam drum 31 is pumped out by the actions of the pumps 32 and 32', respectively, to the evaporator portions $25_2$ and $27_1$ of the waste-heat boilers 25 and 27, in which it is heated until it is returned to the steam drum 31. The steam thus separated by the steam drum 31 is then introduced into the highest-temperature portion or the superheater portion $25_1$ of the water pipe of the waste-heat boiler 25 until it is discharged as the superheated steam to the outside of the heat exchanging system under discussion.

Figure 5:
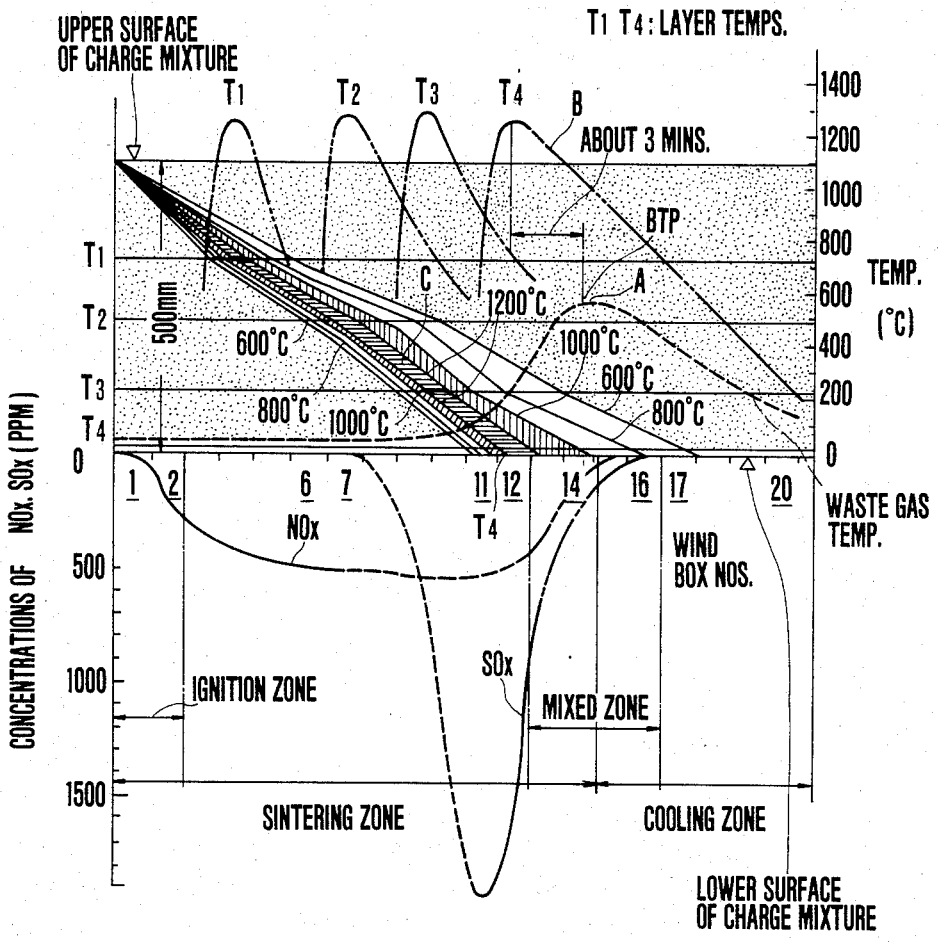
FIG. 5 is a graphical presentation illustrating the patterns of both temperatures and $NO_x$ and $SO_x$ concentrations in the sintering zone, which are plotted against the distance taken along the conveyor.

FIG. 5 illustrates the sintering zone temperature distribution and the $NO_x$ and $SO_x$ concentration patterns along the conveyor in accordance with the present Example. With close reference to FIG. 5, it will be understood that the point at which the sintering reaction is completed is located at the wind box No. 14. More specifically, the instant when the temperatures A of the waste gases reach their maximum in an actual running operation is found to occur approximately three minutes after the temperature of the combustion zone of the lowermost layer has reached the maximum temperature. That instant is referred to as the "Burn Through Point" which is indicated at reference letters BTP. In the present Example, the mixed zone extending from the wind box No. 12 to the wind box No. 16, the latter of which belongs to the cooling zone downstream of the Burn Through Point, allows heat recovery of the waste gases at a high temperature of 400° to 500° C. Furthermore, the waste gases in that mixed zone, which consists of the final stage of the sintering zone and the front state of the cooling zone, still has an oxygen concentration as high as 19 to 20% and a moisture content as low as 1.0 to 1.5% so that the particular waste gases can be advantageously reused as the burning air. Thus, this reuse is conducted for the wind boxes Nos. 3 to 11, which belong to the front and intermediate stages of the sintering zone, so that generation of $NO_x$ can be restricted to 15 to 20%. Incidentally, reference letter C appearing in FIG. 5 indicates the high-temperature zone at 1200° C. or higher, namely, the combustion zone where the charge mixture is being burned.

The high-temperature combustion zone C reaches the lowermost surface at the end of the second group wind boxes $16_2$. Despite of this fact, the sintering reaction at this point is not completed yet, as has been touched in the above, so that the $SO_x$ is still generated at such a considerable rate as will invite the mixing of the $SO_x$ with the waste gases coming from the third and fourth groups of wind boxes $16_3$ belonging to the mixed zone. Therefore, one might deduce that sulfuric acid would condense in the form of droplets on the water pipes of the waste-heat boiler 25 and would cause corrosion of the evaporator and superheating pipes. However, since the pure water has already been heated in the waste-heat boiler 27 so that at least the warm water will flow through those pipes of the waste-heat boiler 25, there is no danger of the pipe corrosion due to the condensation of sulfuric acid.

Next, the experimental conditions and the resultant heat recovery rates in case the waste gas circulation system of the foregoing embodiments was run for actual applications are enumerated in the following:

Production rate of sintered ore: 12,000 tons/day
Supply of pure water: 90 tons/hour (at 20° C.)
Temp. of waste gases into boiler 25: 530° C.
Temp. of waste gases out of boiler 25: 155° C.
Temp. of waste gases into boiler 27: 380° C.
Temp. of waste gases out of boiler 27: 200° C.
Superheated steam: 90 tons/hour (at 370° C., 30 atm.)
Turbine-generated power: 20,000 KW
(For reference, the sintering apparatus has a total power consumption of 10,000 KW.)

Thanks to the construction thus far described, according to the present invention, it is possible to achieve heat recovery of regenerative type while assuring that the boiler components will not be corroded by the waste gases.

What is claimed is:

1. A method for recovering heat from the hot waste gas from a conveyor-type sintering apparatus in which a charge mixture of ore, solid fuel and flux is sintered, said sintering apparatus comprising a sintering zone through which said mixture is moved and is sintered therein and a cooling zone located downstream from said sintering zone and through which said mixture is moved and is cooled therein, said sintering zone having first, second and third groups of wind boxes for withdrawing heated waste gas from said sintering zone, said first, second and third groups of wind boxes being arranged in series in said sintering zone and being located, respectively, at the front stage, intermediate stage and final stage of said sintering zone, said cooling zone having fourth, fifth and sixth groups of wind boxes for withdrawing heated waste gas from said cooling zone, said fourth, fifth and sixth groups of wind boxes being arranged in series in said cooling zone and being located, respectively, at the front stage, intermediate stage and final stage of said cooling zone, the steps comprising:

a first heat exchange step of flowing a first stream of the heated waste gas from said fifth and sixth groups of wind boxes in indirect heat exchange with cold water whereby to extract heat from said first stream of heated waste gas and to heat and said cold water to transform it into hot water; and a second heat exchange step of flowing the hot water obtained in said first step in indirect heat exchange with a second stream of heated waste gas from said third and fourth groups of wind boxes whereby to extract heat from said second stream of heated waste gas and to heat said hot water to transform it into steam, said second stream of heated waste gas containing sulfur oxides and being maintained, in said second step, at a relatively high temperature effective to prevent condensation of said sulfur oxides in the form of droplets of sulfuric acid.

2. A method as claimed in claim 1 in which, prior to said second heat exchange step, said second stream of heated waste gas is employed in a third heat exchange step in which it is flowed in indirect heat exchange with the steam that is produced in said second heat exchange step in order to convert said steam to superheated steam.

3. A method according to claim 2 including the steps of circulating said second stream of waste gas, after it has been discharged from said second heat exchange step, into said front and intermediate stages of said sintering zone on the opposite side of the mixture therein from said first and second groups of wind boxes so that said second stream of waste gas is drawn through the mixture and then is removed by said first and second groups of wind boxes; and circulating said first stream of waste gas, after it has been discharged from said first heat exchange step, into said final stage of said sintering zone and said front stage of said cooling zone on the opposite side of the mixture therein from said third and fourth groups of wind boxes so that said first stream of waste gas is drawn through the mixture and then is removed by said third and fourth groups of wind boxes and becomes said second stream.

4. A method according to claim 3, further comprising:

supplying fresh air to the zone above the conveyor and above said fifth and sixth groups of wind boxes, whereby the fresh air supplied is circulated to act as a heat recovering and transferring medium and it passes in series through the sintered material carried on the conveyor above said fifth and sixth groups of wind boxes, through said first heat exchanging step, through the sintered material carried on the conveyor above said third and fourth groups of wind boxes, through the second heat exchanging step, and then through the mixture carried on the conveyor above said first and second groups of wind boxes, in the recited order.

5. A method according to claim 4, further comprising:

discharging a third stream of the waste gas which has passed through said second group of wind boxes;

removing both sulfur oxides and nitrogen oxides from said third stream;

discharging a fourth stream of the waste gas which has passed through said first group of wind boxes; and separating dust from said third and fourth streams and then discharging said third and fourth streams.

6. A method according to claim 5, further comprising:

discharging a fifth stream of waste gas, which has passed through the charge mixture being ignited to start its sintering reaction, together with the fourth stream.

7. A method according to claim 2, in which, prior to said first heat exchange step, said first stream of heated waste gas is employed in a fourth heat exchange step in which it is flowed in indirect heat exchange with said hot water thereby to heat said hot water into hotter water.

8. A method according to claim 2, wherein said second stream of heated waste gas comes from that portion of said charge mixture in which the sintering reaction is completed.

9. A method according to claim 8, wherein said portion is located to extend over the Burn Through Point of said sintering apparatus.

* * * * *